US010048634B2

(12) United States Patent
Kanzawa

(10) Patent No.: US 10,048,634 B2
(45) Date of Patent: Aug. 14, 2018

(54) MEDIUM FEEDING UNIT AND IMAGE FORMING APPARATUS

(71) Applicant: Oki Data Corporation, Tokyo (JP)

(72) Inventor: Naoki Kanzawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/241,574

(22) Filed: Aug. 19, 2016

(65) Prior Publication Data

US 2017/0068200 A1 Mar. 9, 2017

(30) Foreign Application Priority Data

Sep. 8, 2015 (JP) ..... 2015-176634

(51) Int. Cl.

| | |
|---|---|
| ***B65H 5/06*** | (2006.01) |
| ***G03G 15/00*** | (2006.01) |
| ***B65H 16/04*** | (2006.01) |
| ***B65H 35/00*** | (2006.01) |
| ***B65H 35/08*** | (2006.01) |
| ***B65H 16/10*** | (2006.01) |

(52) U.S. Cl.

CPC ..... *G03G 15/6529* (2013.01); *B65H 5/06* (2013.01); *B65H 16/04* (2013.01); *B65H 16/103* (2013.01); *B65H 35/0006* (2013.01); *B65H 35/08* (2013.01); *G03G 15/652* (2013.01); *B65H 2301/121* (2013.01); *B65H 2301/122* (2013.01); *B65H 2301/41358* (2013.01); *B65H 2301/413223* (2013.01); *B65H 2404/147* (2013.01); *B65H 2405/40* (2013.01); *B65H 2511/112* (2013.01); *B65H 2553/40* (2013.01); *B65H 2701/1311* (2013.01); *G03G 2215/00455* (2013.01); *G03G 2215/0129* (2013.01)

(58) Field of Classification Search

CPC .. B65H 5/06; B65H 16/103; B65H 2301/121; B65H 2301/413223; B65H 2301/41358; B65H 2404/147; B65H 2511/112; B65H 2553/40; B65H 2701/1311; B65H 160/04; B65H 35/0006; B65H 2301/122; B65H 2405/40; B65H 35/08; G03G 15/6529

See application file for complete search history.

(56) References Cited

U.S. PATENT DOCUMENTS 4,854,806 A * 8/1989 Gertsch ..... B65H 19/126 242/533.4

6,030,496 A * 2/2000 Baggot ..... B65H 16/10 162/111

(Continued)

FOREIGN PATENT DOCUMENTS

JP 2013-112473 A 6/2013

*Primary Examiner* — Jill Culler

*Assistant Examiner* — Marissa Ferguson Samreth

(74) *Attorney, Agent, or Firm* — Muncy, Geissler, Olds & Lowe, P.C.

(57) ABSTRACT

A medium feeding unit that is configure to be mounted to an image forming apparatus provided with an image forming unit and feeds a medium to the image forming unit includes a medium introducing part that introduces the medium to the image forming unit and a medium holding part that holds the medium at a feeding position from which the medium is fed to the image forming unit. The medium holding part is configured to be positioned at one of at least two different feeding positions relative to the medium introducing part.

6 Claims, 12 Drawing Sheets

(56) References Cited

U.S. PATENT DOCUMENTS

| | | | | |
|---|---|---|---|---|
| 7,500,634 | B2 * | 3/2009 | Benvenuti | B65H 19/1836 242/552 |
| 2014/0099149 | A1 * | 4/2014 | Kikura | B41J 3/4075 400/619 |
| 2016/0280500 | A1 * | 9/2016 | Lin | B26F 1/20 |
| 2017/0102014 | A1 * | 4/2017 | Re | B65H 75/243 |

* cited by examiner

MEDIUM FEEDING UNIT AND IMAGE FORMING APPARATUS

CROSS REFERENCE TO RELATED APPLICATION

This application claims priority under 35 USC 119 to Japanese Patent Application No. 2015-176634 filed on Sep. 8, 2015, the entire contents which are incorporated herein by reference.

TECHNICAL FIELD

The present invention relates to an image forming apparatus that forms an image using an electrophotographic method, and relates to a medium feeding unit that is mounted to the image forming apparatus.

BACKGROUND

A recording apparatus (printer) is proposed that allows printing to be performed both on a manual feed sheet and on a roll sheet (for example, see [Patent Document 1]).

RELATED ART

[Patent Document 1] Japanese Patent Laid-Open Publication No. 2013-112473.

For such a printer, it is desirable to reduce a size of an overall configuration.

The present invention has been accomplished in view of such a problem, and is intended to provide an image forming apparatus having a structure capable of being installed in a narrower place, and to provide a medium feeding unit capable of being suitably mounted to the image forming apparatus.

SUMMARY

A medium feeding unit, disclosed in the application, that is configure to be mounted to an image forming apparatus provided with an image forming unit and feeds a medium to the image forming unit includes a medium introducing part that introduces the medium to the image forming unit and a medium holding part that holds the medium at a feeding position from which the medium is fed to the image forming unit. The medium holding part is configured to be positioned at one of at least two different feeding positions relative to the medium introducing part.

With the medium feeding unit and image forming apparatus as one embodiment of the invention, since the medium is placed at several different positioned with respect to the medium introducing part, the medium holding part is placed at a proper position with respect to the medium introducing part.

The image forming apparatus as an embodiment of the present invention is suitable for installation in a narrower place. Further, the medium feeding unit as an embodiment of the present invention can be suitably mounted to such an image forming apparatus.

DETAILED DESCRIPTION OF THE EMBODIMENTS

Figure 1:
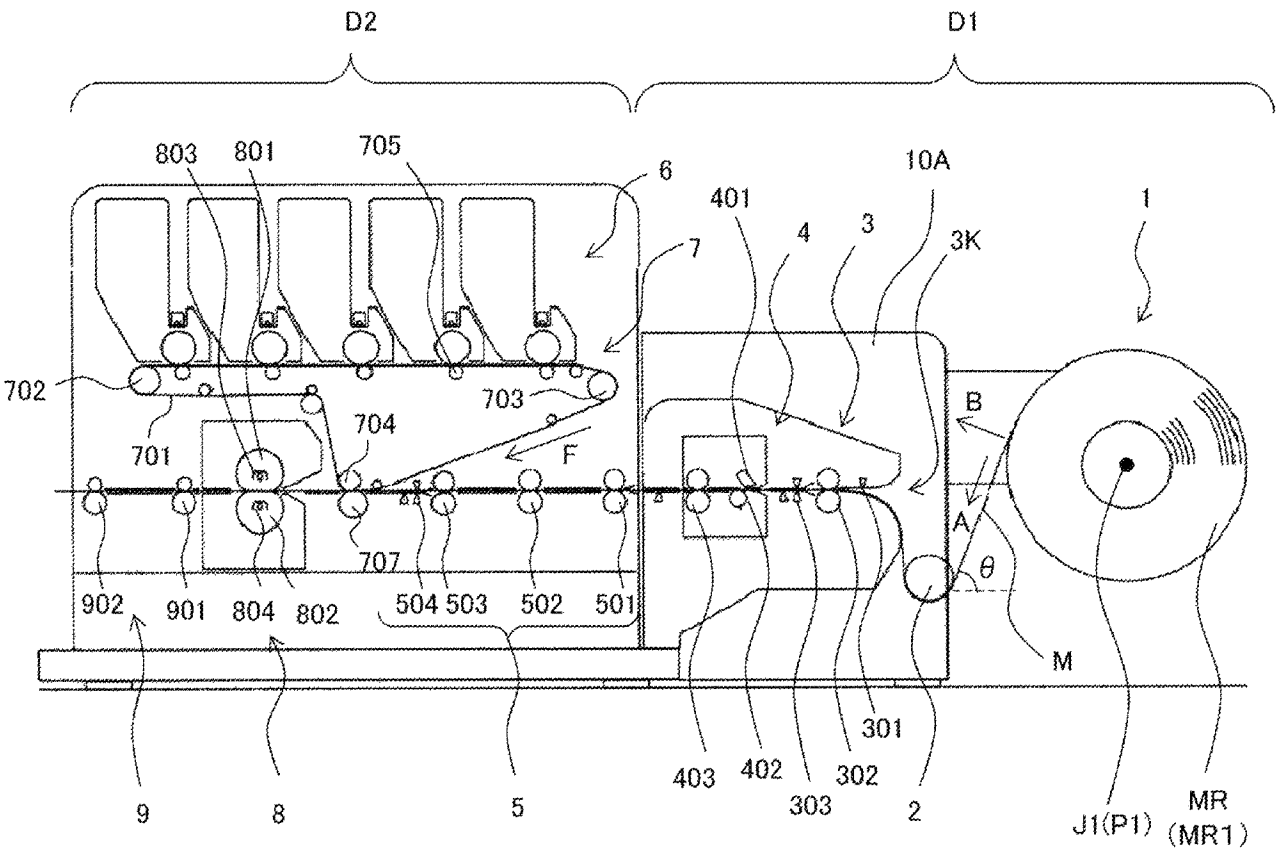
FIG. 1 is a schematic diagram illustrating an example of an overall configuration of an image forming apparatus according to a first embodiment of the present invention.

In the following, embodiments of the present invention are described with reference to the drawings. The following description is a specific example of the present invention. The present invention is not limited to the following embodiments. Further, the present invention is not limited to arrangements, dimensions, dimension ratios and the like of configuration elements illustrated in the drawings. The description will be presented in the following order:

1. First embodiment (an image forming apparatus provided with a medium feeding unit having a basic structure)
2. Second embodiment (an image forming apparatus provided with a medium feeding unit having a movable arm part)
3. Other modified embodiments

1. First Embodiment

[Schematic Configuration]

FIG. 1 is a schematic diagram illustrating an example of an overall configuration of an image forming apparatus according to a first embodiment of the present invention. The image forming apparatus is, for example, an electrophotographic printer that forms an image (for example, a color image) on a medium (which is also referred to as a sheet, a recording medium, a print medium, or a transfer material) M.

As illustrated in FIG. 1, the image forming apparatus includes, for example, a medium feeding unit D1 and an image forming unit D2. The medium feeding unit D1 rotatably holds a roll (wound structure) MR, which is a target object of image formation and is formed by winding the medium M, and feeds the medium M toward the image forming unit D2 on a downstream side when a print operation is performed. The medium feeding unit D1 corresponds to a specific example of a "medium feeding unit" of the present invention. Further, the image forming unit D2 transfers and fuses a developer image (toner image) onto the medium M that is fed from the medium feeding unit D1. The image forming unit D2 corresponds to a specific example of an "image forming unit" of the present invention.

The medium feeding unit D1 includes, for example, a holder 1, a tension roller 2, a medium carrying part 3 and a medium cutting part 4 in this order from an upstream side toward a downstream side. The roll MR is held by the holder 1 so as to be rotatable about an axis J1 as a rotation axis. The holder 1 corresponds to a specific example of a "medium holding part" of the present invention, and the tension roller 2 corresponds to a specific example of a "medium introducing part" of the present invention. The image forming unit D2 includes a write timing adjustment carrying part 5, an image forming part 6 and an intermediate transfer unit 7, a fuser 8, and an ejection carrying part 9 in this order from an upstream side toward a downstream side.

The medium M fed from the holder 1 is carried in the order of the tension roller 2, the medium carrying part 3, the medium cutting part 4, the write timing adjustment carrying part 5, the image forming part 6 and the intermediate transfer unit 7, the fuser 8, and the ejection carrying part 9. In the present specification, in a direction along which the medium M is fed, when viewed from any position, a position close to the holder 1, which is a supply source of the medium M, is referred to as a position on an upstream side, and a position distant from the holder 1 is referred to as a position on a downstream side. Further, in the present specification, a direction orthogonal to the feeding direction of the medium M (a direction perpendicular to a paper surface of FIG. 1) is referred to as a lateral direction.

In the holder 1, the roll MR is set such that a print surface of the medium M on which a toner image is formed faces, for example, an arrow B direction.

In the medium carrying part 3, for example, a leading edge detection sensor 301, a feed roller pair 302 and a leading edge detection sensor 303 are provided in this order from an upstream side toward a downstream side. The leading edge detection sensors 301, 303 are position detection sensors that detect a leading edge of the medium M. When the medium M is detected by the leading edge detection sensor 301, the feed roller pair 302 starts driving and feeds the medium M to downstream.

The medium cutting part 4 has a fixed blade 401, a rotary blade 402, and a roller pair 403. In the medium cutting part 4, the medium M is cut into a predetermined length by rotating the rotary blade 402 in a predetermined direction relative to the fixed blade 401. The roller pair 403, by rotating, carries the medium M to the write timing adjustment carrying part 5 that is positioned on a downstream side.

The write timing adjustment carrying part 5 that is positioned on a downstream side of the medium cutting part 4 feeds the medium M to a secondary transfer roller 707 (to be described later) in the intermediate transfer unit 7 while adjusting timing. The write timing adjustment carrying part 5 includes, for example, timing adjustment roller pairs 501-503 and a leading edge detection sensor 504 in this order from an upstream side. The timing adjustment roller pairs 501-503 are members that carry the medium M while adjusting a carrying speed and timing. The leading edge detection sensor 504 is a sensor that detects a leading edge position of the carried medium M.

The image forming part 6 is arranged on an upper side of the intermediate transfer unit 7, and has development apparatuses that each form a toner image of a specific color. The image forming part 6 forms the toner images of the colors on a surface of an intermediate transfer belt 701 (to be described later) of the intermediate transfer unit 7 using an electrophotographic method.

The intermediate transfer unit 7 has, for example, the intermediate transfer belt 701, a drive roller 702, a tension roller 703, a secondary transfer backup roller 704, a primary transfer roller 705, and a secondary transfer roller 707. The intermediate transfer belt 701 is, for example, an endless elastic belt formed of a resin material such as a polyimide resin. The intermediate transfer belt 701 is stretched by the drive roller 702, the tension roller 703, the secondary transfer backup roller 704 and the like. The drive roller 702 is a member that is driven by a drive motor and causes the intermediate transfer belt 701 to rotate in a predetermined carrying direction F. The tension roller 703 is a driven roller that follows the rotation of the intermediate transfer belt 701, and functions to apply a tensional force to the intermediate transfer belt 701 due to a bias force from a biasing member such as a coil spring. The primary transfer roller 705 is arranged so as to oppose the image forming part 6 across the intermediate transfer belt 701, and applies a predetermined voltage when a toner image formed by the development apparatuses is transferred to the surface of the intermediate transfer belt 701. Further, the secondary transfer backup roller 704 and the secondary transfer roller 707 are arranged on a site opposite to the image forming part 6 (lower portion of the intermediate transfer belt unit 7) so as to oppose each other across the intermediate transfer belt 701, and form a secondary transfer part. The secondary transfer backup roller 704 and the secondary transfer roller 707 secondarily transfer a toner image to the medium M, the toner image having been primarily transferred to the surface of the intermediate transfer belt 701. The intermediate transfer belt unit 7 uses the function of the write timing adjustment carrying part 5 when secondarily transferring the toner image to the medium M so as to achieve synchronization with the timing of when the image forming part 6 forms the toner image on the intermediate transfer belt 701.

The fuser 8 is provided on a downstream side of the intermediate transfer belt unit 7. The fuser 8 applies heat and pressure to a toner image that has been transferred to the medium M and melts and fuses the toner image onto the medium M, the medium M being carried from the secondary transfer part that is formed by the secondary transfer backup roller 704 and the secondary transfer roller 707. The fuser 8 has a pair of rollers 801, 802 that are in contact with each other and press against each other with a predetermined pressure, a heat source 803 that is built in the roller 801 and applies heat to the roller 801, and a heat source 804 that is built in the roller 802 and applies heat to the roller 802. The heat sources 803, 804 are, for example, halogen lamps.

The ejection carrying part 9 is provided on a downstream side of the fuser 8, and has carrying roller pairs 901, 902.

The carrying roller pairs 901, 902 eject the medium M, which is carried from the fuser 8, to outside of the image forming unit D2.

[Detailed Configuration of Medium Feeding Unit D1]

Figure 2:
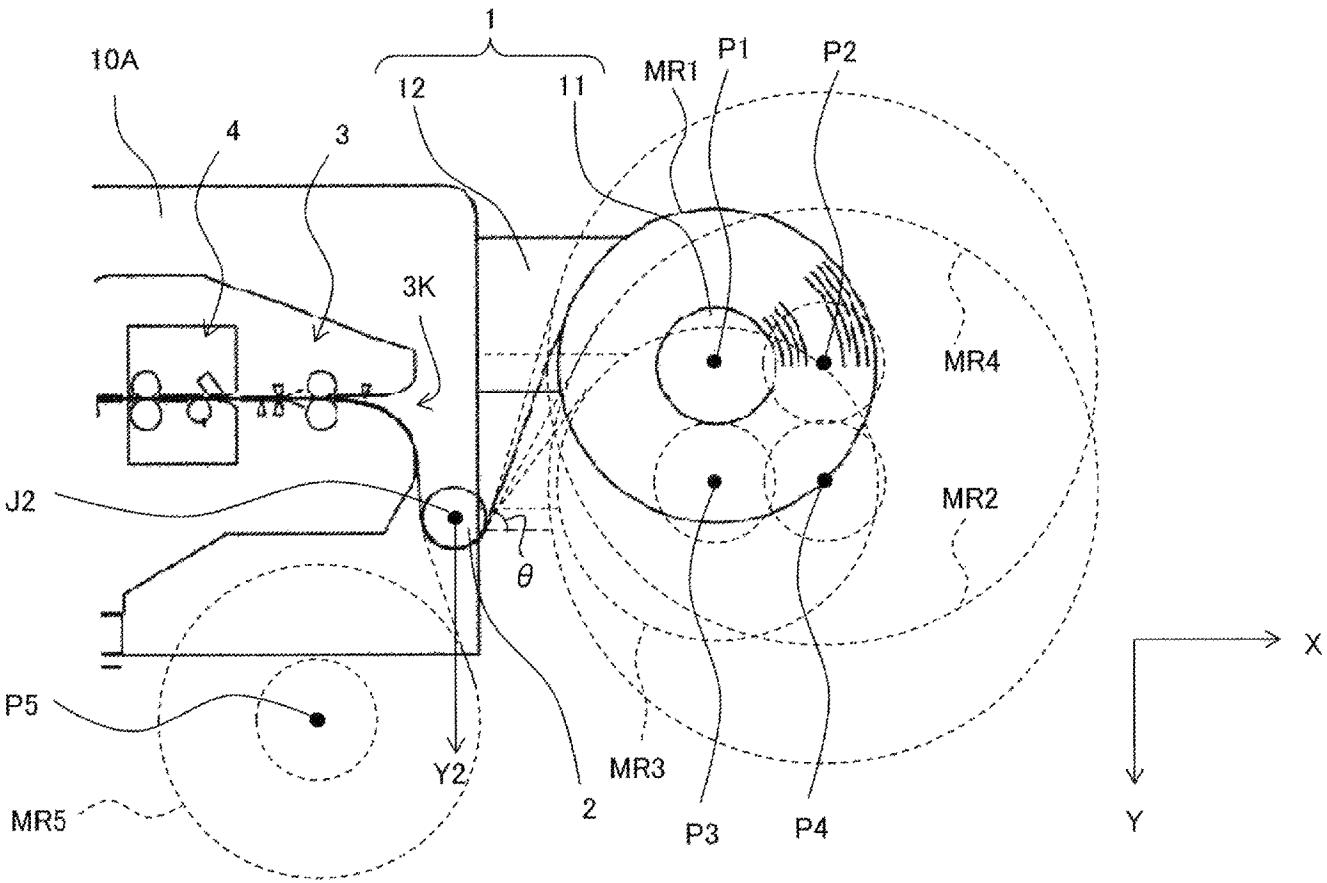
FIG. 2 is a schematic diagram for describing a function of a medium feeding unit illustrated in FIG. 1.
Figure 3A:
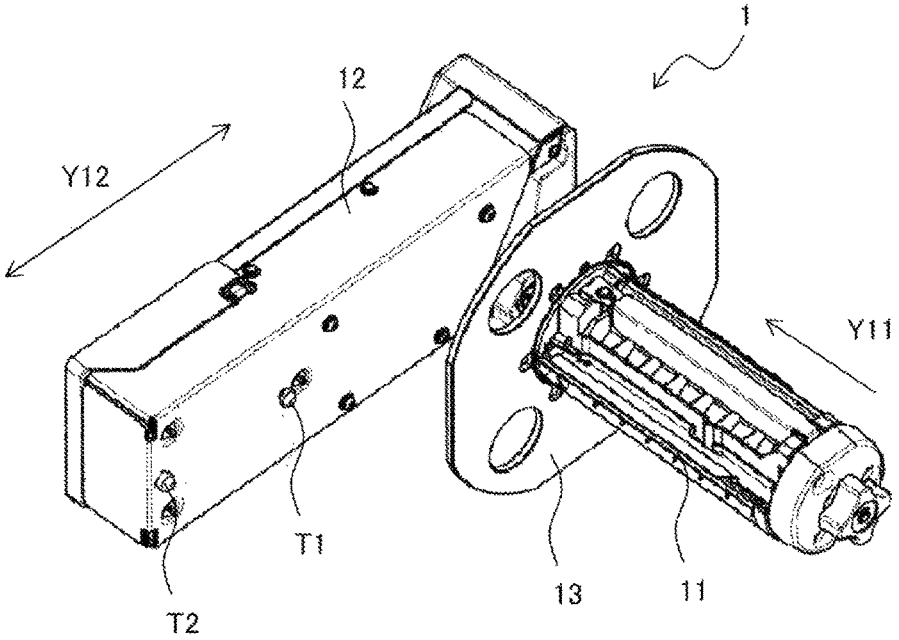
FIG. 3A is a perspective view illustrating an external appearance of the medium feeding unit illustrated in FIG. 1.
Figure 3B:
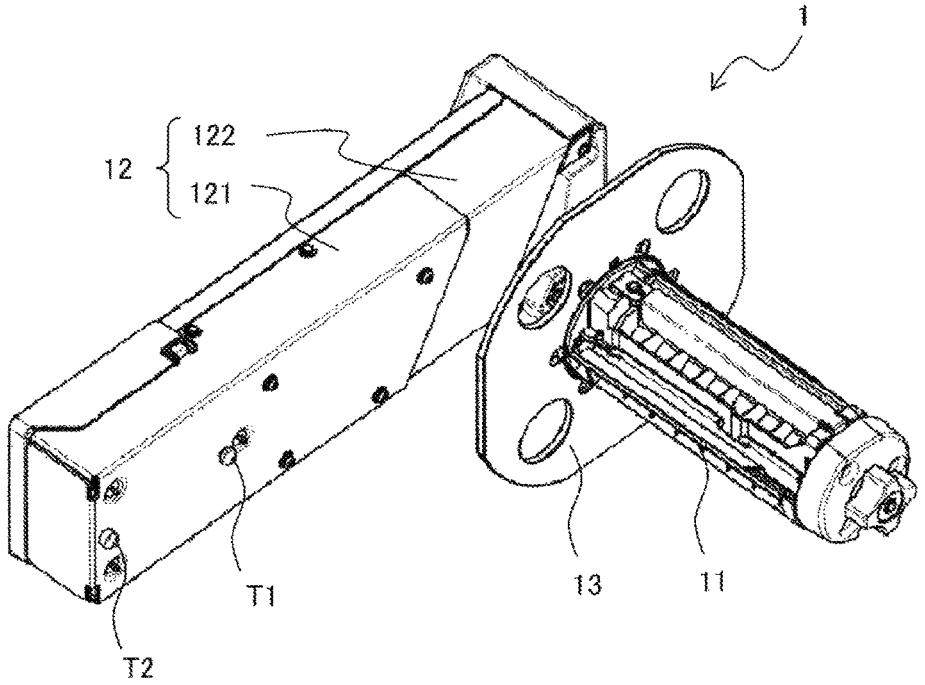
FIG. 3B is a perspective view illustrating an external appearance of the medium feeding unit illustrated in FIG. 1.
Figure 4A:
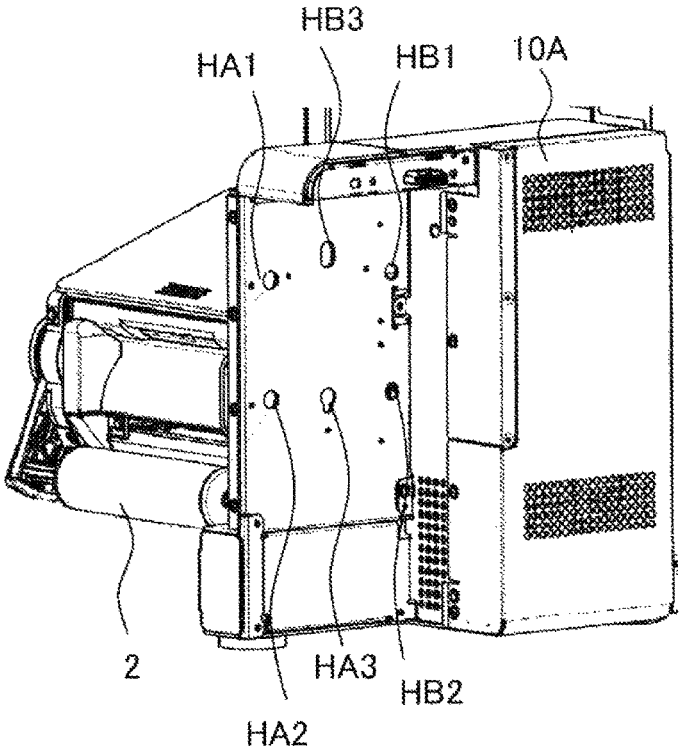
FIG. 4A is a perspective view illustrating an external appearance of the medium feeding unit illustrated in FIG. 1 in a state in which some configuration elements are detached.
Figure 4B:
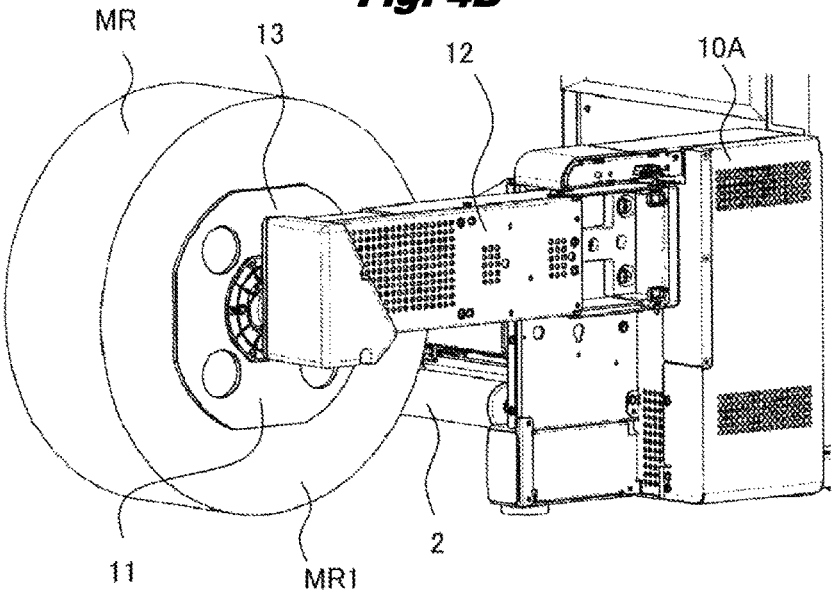
FIG. 4B is a perspective view illustrating an external appearance of the medium feeding unit illustrated in FIG. 1 in a first state in which a medium is attached.
Figure 4C:
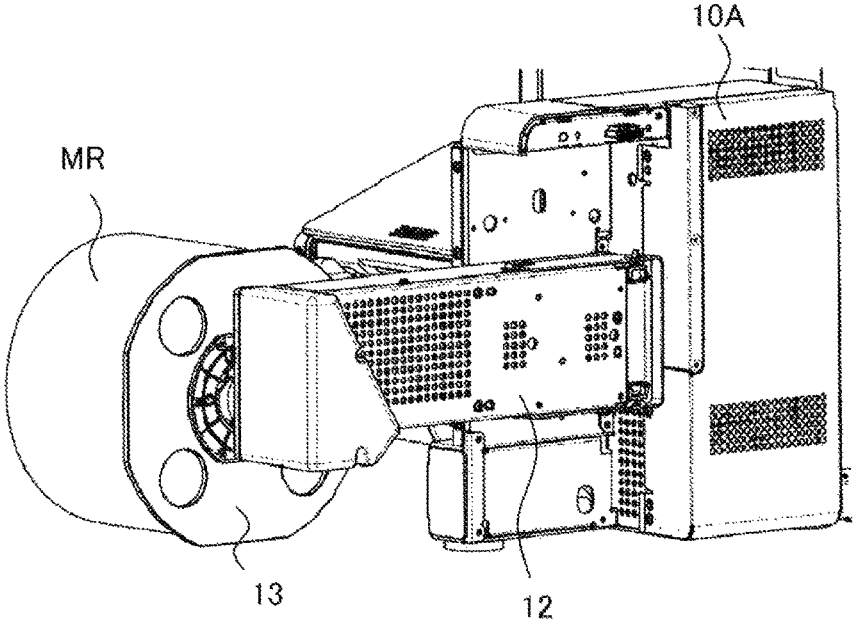
FIG. 4C is a perspective view illustrating an external appearance of the medium feeding unit illustrated in FIG. 1 in a second state in which a medium is attached.
Figure 4D:
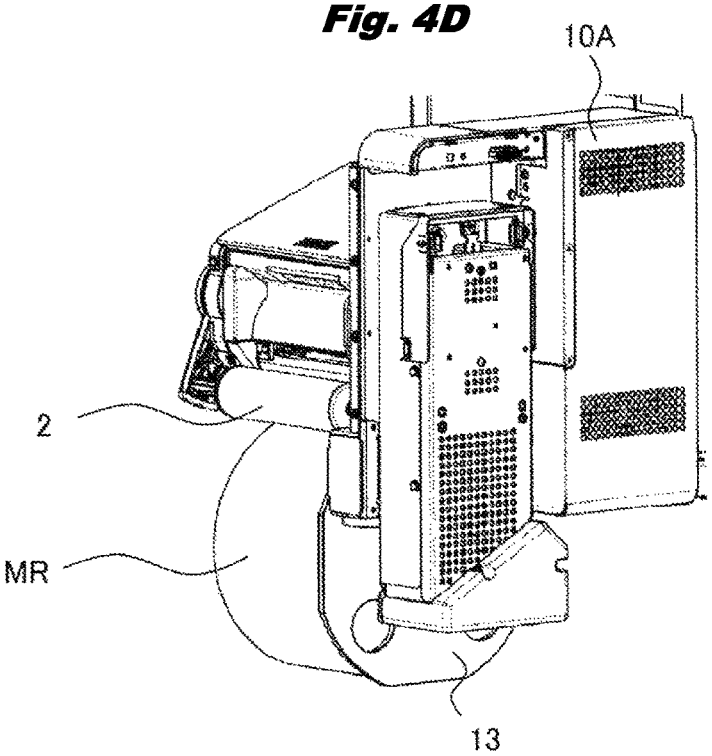
FIG. 4D is a perspective view illustrating an external appearance of the medium feeding unit illustrated in FIG. 1 in a third state in which a medium is attached.
Figure 5:
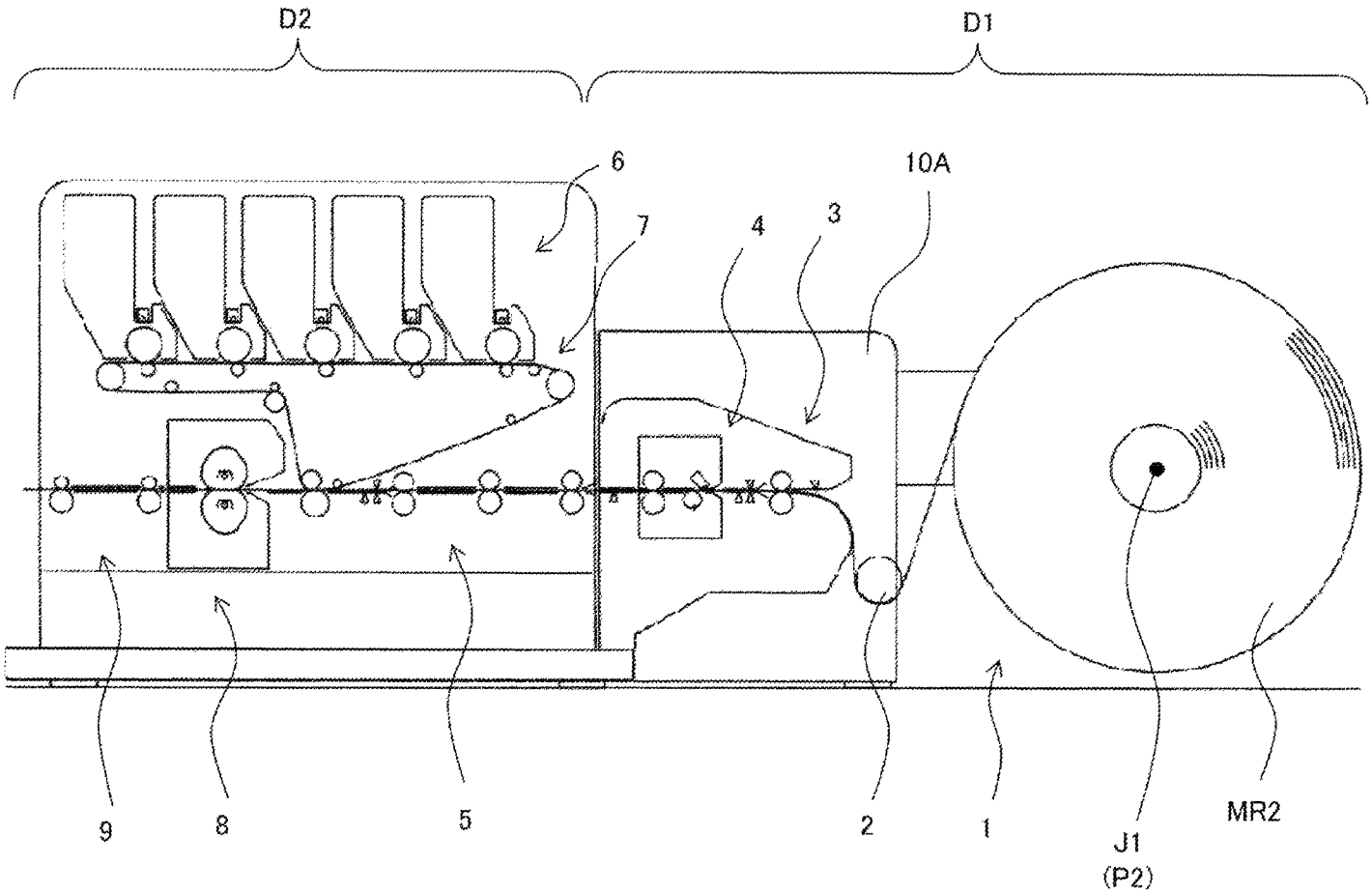
FIG. 5 is a schematic diagram illustrating an overall configuration of the image forming apparatus that is provided with the medium feeding unit in the first state illustrated in FIG. 4B.
Figure 6:
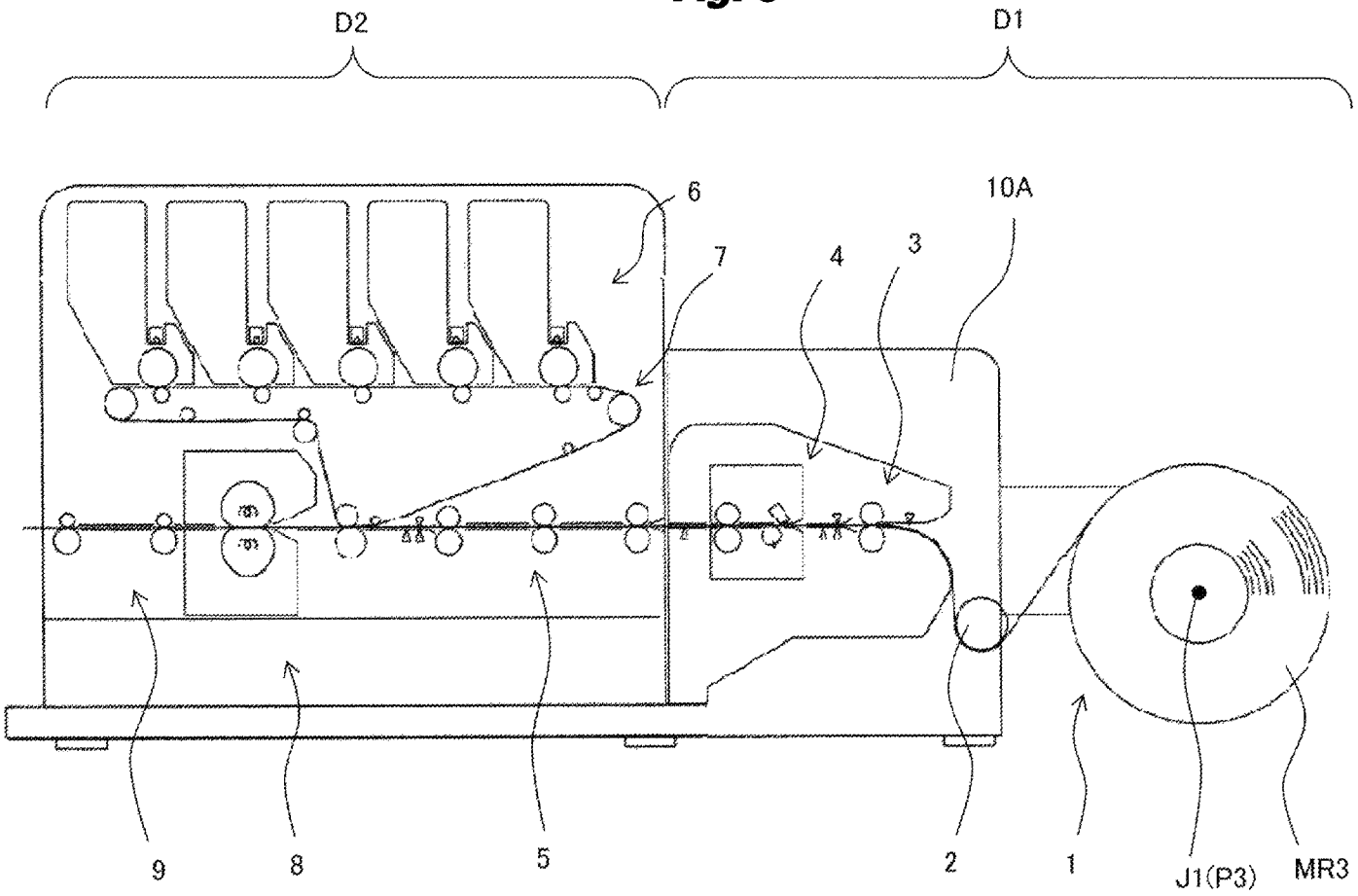
FIG. 6 is a schematic diagram illustrating an overall configuration of the image forming apparatus that is provided with the medium feeding unit in the second state illustrated in FIG. 4C.
Figure 7:
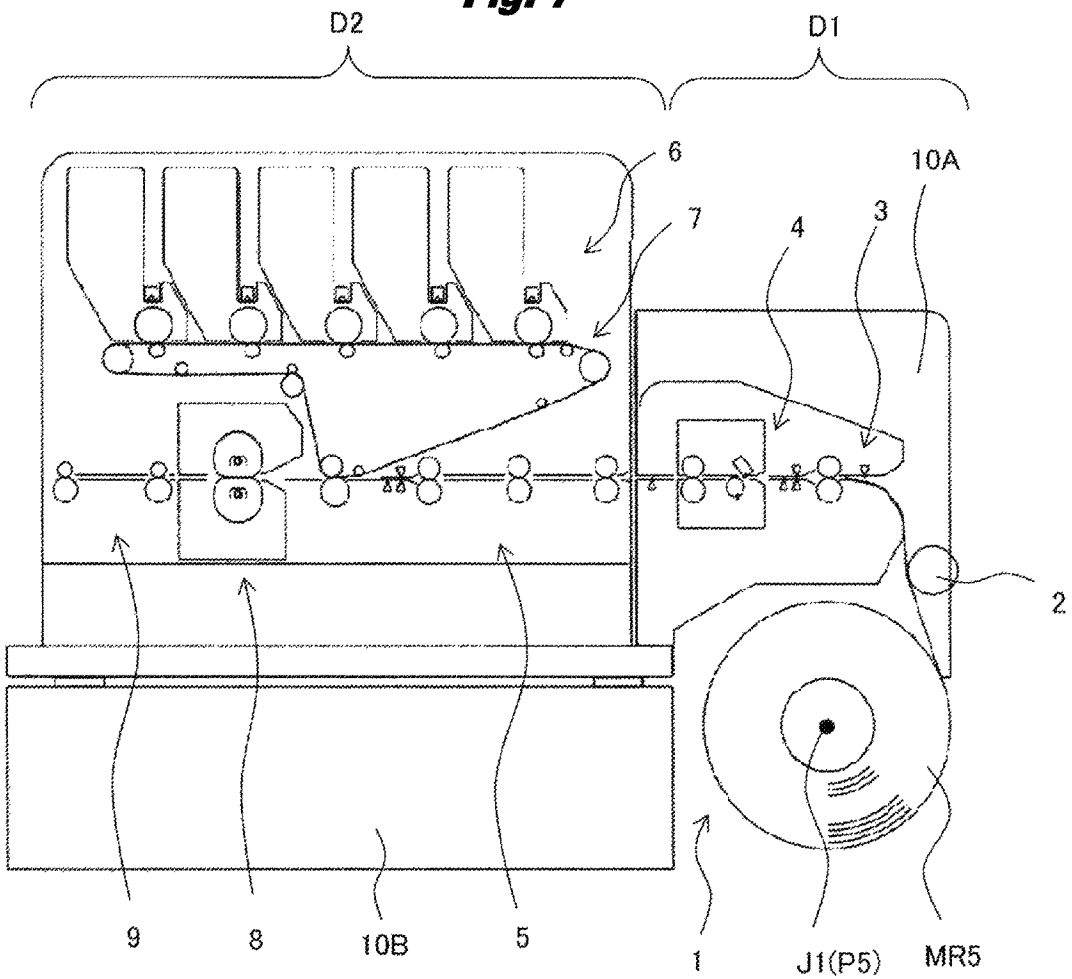
FIG. 7 is a schematic diagram illustrating an overall configuration of the image forming apparatus that is provided with the medium feeding unit in the third state illustrated in FIG. 4D.

Next, a detailed configuration of the medium feeding unit D1 is described with reference to FIGS. 2-7. FIG. 2 is a schematic diagram for describing a function of the medium feeding unit D1. FIGS. 3A and 3B are perspective views that each illustrates an external appearance of the medium feeding unit D1. FIG. 4A is a perspective view illustrating an external appearance of the medium feeding unit D1 in a state in which a support part 11 (to be described later) and an arm part 12 (to be described later) of the medium feeding unit D1 are detached. FIGS. 4B-4D are perspective views that each illustrates an external appearance of the medium feeding unit D1 in a state in which the medium M is attached to the holder 1. FIGS. 5-7 are schematic diagrams that each illustrates an overall configuration of the image forming apparatus in a state in which the medium M is attached to the holder 1.

The medium feeding unit D1 includes the holder 1 as the "medium holding part" that holds the medium M, the tension roller 2 as the "medium introducing part" that introduces the medium M to the image forming unit D2, the medium carrying part 3, and the medium cutting part 4. The holder 1 is provided detachable with respect to a main body part 10A. The tension roller 2, the medium carrying part 3 and the medium cutting part 4 are also provided in the main body part 10A. Further, as illustrated in FIG. 4A, holes HA1-HA3 and holes HB1-HB3 are formed in the main body part 10A. The tension roller 2 is held by the main body part 10A so as to be movable, for example, along a Y-axis direction, is positioned between the holder 1 and a medium inlet 3K of the medium carrying part 3, and functions so as to apply a predetermined tension force to the medium M, for example, in an arrow Y2 direction. That is, the tension roller 2 functions as a "tension force application part" that applies a tension force to the medium M. The tension roller 2 is formed so as to be rotatable about an axis J2 (see FIG. 2). The holder 1 includes the support part 11 that rotatably supports the roll MR that is formed from the medium M, the arm part 12 of which one end is attached to the support part 11 and the other end is attached to the main body part 10A, and a plate-like member 13 that is provided on an end part of the support part 11 on a side near the arm part 12.

The support part 11 is, for example, a shaft that extends in an arrow Y11 direction that is orthogonal to a longitudinal direction of the arm part 12 (see FIGS. 3A and 3B) and has the axis J1 as a central axis. The support part 11 is inserted into a paper tube of the roll MR. When the roll MR is attached to the support part 11 in the arrow Y11 direction, an end surface MR1 of the roll MR is in contact with a surface of the plate-like member 13 (see FIG. 4B).

Further, the arm part 12 is formed to be extendable and contractible along its longitudinal direction (for example, an arrow Y12 direction illustrated in FIGS. 3A and 3B). The arm part 12 has an outer portion 121 and an inner portion 122, and is formed such that the inner portion 122 slidable with respect to the outer portion 121. That is, the arm part 12 is formed is formed such that state transition between a contraction state in which the inner portion 122 is accommodated in the outer portion 121 and an extension state in which the inner portion 122 is exposed from the outer portion 121. Further, the arm part 12 has a projection T1 that is fitted to one of the holes HA1-HA3 of the main body part 10A when the arm part 12 is attached to the main body part 10A, and a projection T2 that is fitted to one of the holes HB1-HB3 of the main body part 10A when the arm part 12 is attached to the main body part 10A.

As illustrated in FIG. 2, the support part 11 of the holder 1 is formed so as to be installed or to be capable of being installed at different feeding positions P1-P5 (hereinafter, simply referred to as positions P1-P5) relative to the tension roller 2. That is, in the medium feeding unit D1, the installation position of the support part 11 on the arm part 12 relative to the main body part 10A and the expansion and contraction state of the arm part 12 can be changed such that the axis J1 of the support part 11 matches one of the positions P1-P5 on an XY plane. In this case, an X-axis direction is a horizontal direction, and a Y-axis direction is a vertical direction. In this way, the holder 1 is formed such that the position of the support part 11 relative to the tension roller 2 can be changed. By changing the position of the support part 11 relative to the tension roller 12, an entry angle θ (see FIG. 1) of the medium M relative to the tension roller 2 can be adjusted. Here, the entry angle θ of the medium M is an angle formed by the medium M relative to the horizontal direction at a contact point between the medium M and the tension roller 2. The entry angle θ is a specific example of "an entry angle of a medium relative to a medium introducing part" of the present invention.

In this way, in the medium feeding unit D1, the position (relative position) of the support part 11 relative to the tension roller 2 can be selected according to a thickness, a type and a winding amount (remaining amount) of the medium M.

(Position P1)

FIG. 1 illustrates a state in which the holder 1 is set such that the support part 11 is at the position P1. In this case, the arm part 12 is in the contraction state, and the axis J1 of the support part 11 is in a state of being close to the main body part 10A. The arm part 12 is fixed to the main body part 10A such that the projection T1 is fitted to the hole HA1 and the projection T2 is fitted to the hole HB1. A roll MR1 attached to the support part 11 at the position P1 has a relatively small winding amount. Further, when the support part 11 is at the position P1, the entry angle θ of the medium M that is fed from the roll MR1 is large as compared to that in a case where the support part 11 is at the position P3 (see FIG. 2).

(Position P2)

FIGS. 4B and 5 illustrate a state in which the holder 1 is set such that the support part 11 is at the position P2. In this case, the arm part 12 is in the extension state, and the axis J1 of the support part 11 is in a state of being far from the main body part 10A as compared to the case of the position P1. The arm part 12 is fixed to the main body part 10A such that the projection T1 is fitted to the hole HA1 and the projection T2 is fitted to the hole HB1. A roll MR2 attached to the support part 11 at the position P2 has a relatively large winding amount (larger than that of the roll MR1). Further, when the support part 11 is at the position P2, the entry angle θ of the medium M that is fed from the roll MR2 is large as compared to that in a case where the support part 11 is at the position P4 (see FIG. 2).

(Position P3)

FIGS. 4C and 6 illustrate a state in which the holder 1 is set such that the support part 11 is at the position P3. In this case, the arm part 12 is in the contraction state, and the axis J1 of the support part 11 is in a state of being close to the main body part 10A. The arm part 12 is fixed to the main body part 10A such that the projection T1 is fitted to the hole HA2 and the projection T2 is fitted to the hole HB2. A roll MR3 attached to the support part 11 at the position P3 has a relatively small winding amount. Further, when the support part 11 is at the position P3, the entry angle θ of the medium M that is fed from the roll MR3 is small as compared to that in the case where the support part 11 is at the position P1 (see FIG. 2).

(Position P4)

When the holder 1 is set such that the support part 11 is at the position P4, the arm part 12 is in the extension state, and the axis J1 of the support part 11 is in a state of being far from the main body part 10A as compared to the case of the position P3 (see FIG. 2). The arm part 12 is fixed to the main body part 10A such that the projection T1 is fitted to the hole HA2 and the projection T2 is fitted to the hole HB2. A roll MR4 attached to the support part 11 at the position P4 has a relatively large winding amount (larger than that of the roll MR3). Further, when the support part 11 is at the position P4, the entry angle θ of the medium M that is fed from the roll MR4 is small as compared to that in the case where the support part 11 is at the position P2 (see FIG. 2).

(Position P5)

FIGS. 4*d* and 7 illustrate a state in which the holder 1 is set such that the support part 11 is at the position P5. In this case, the arm part 12 is fixed to the main body part 10A such that the projection T1 is fitted to the hole HA3 and the projection T2 is fitted to the hole HB3 so that the arm part 12 extends in the vertical direction. Therefore, a roll MR5 attached to the support part 11 is positioned below the medium carrying part 3. In order to ensure a space that accommodates the roll MR5, the main body part 10A of the medium feeding unit D1 and the image forming unit D2 are placed on a pedestal part 10B. Further, the arm part 12 is in the contraction state, and the axis J1 of the support part 11 is in a state of being close to the main body part 10A. The roll MR5 has a relatively small winding amount.

(Wrapping Angles θ1 to θ5)

Figure 9A:
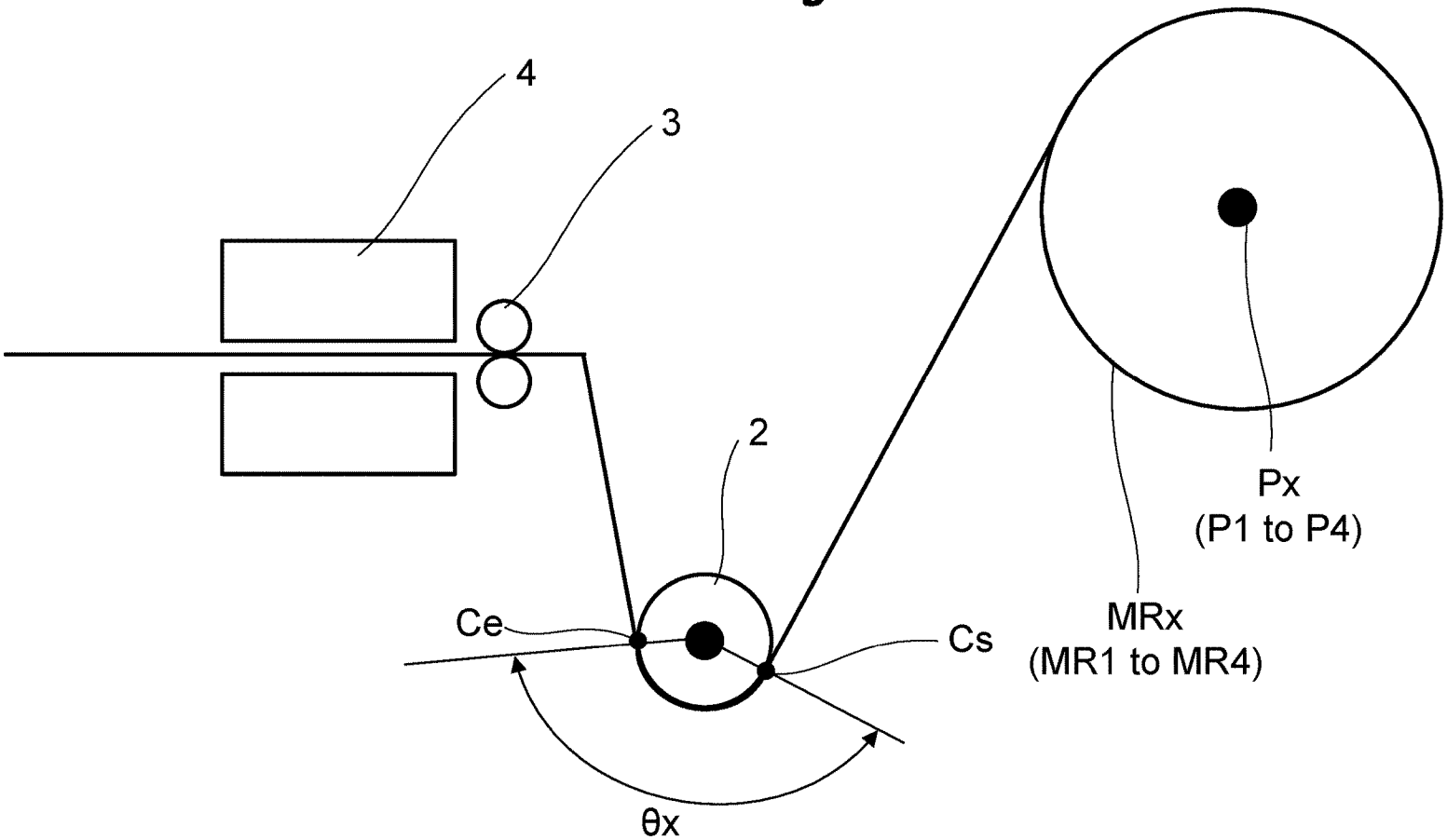
FIG. 9A and FIG. 9B are schematic views of tension roller 2 and a roll sheet running around the roller for illustrating wrapping angle θ1 to θ5.
Figure 9B:
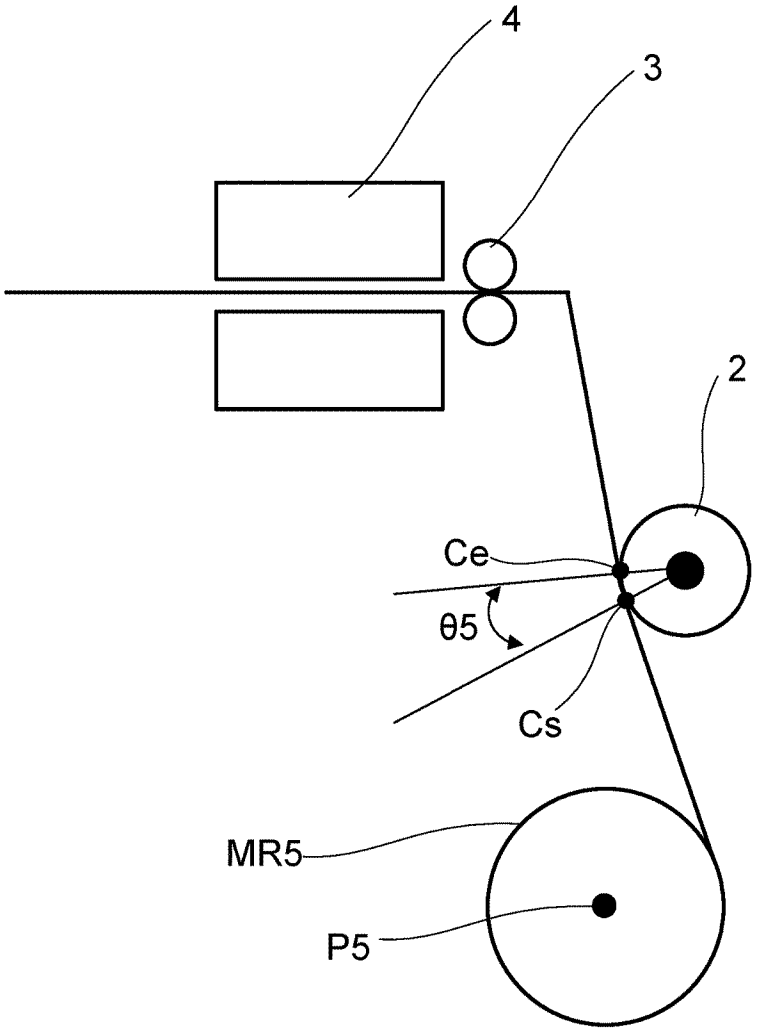
Figure 9C:
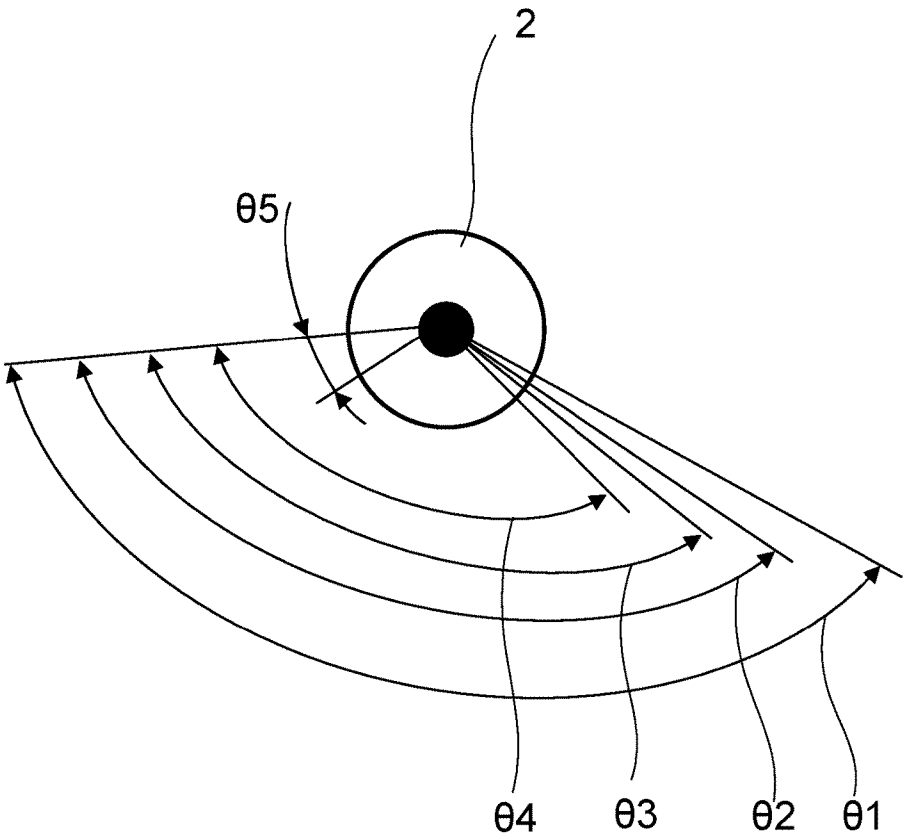
FIG. 9C illustrates relationship among wrapping angles θ1 to θ5.

Using FIGS. 9A and 9C, wrapping angles θ1 to θ5 are described. The wrapping angles are defined as angles around tension roller 2 between two surface points Cs and Ce. Surface point Cs, which is a wrap start point, is a point where the medium (or sheet) coming from the roll comes in contact with tension roller 2. Surface point Ce, which is a wrap end point, is a point where the medium begins to separate from tension roller 2. Namely, the wrapping angle is determined as an angle where the medium wraps the tension roller (or an area where the medium contacts the tension roller). Since the roller has several feeding positions P1 to P5, each of the feeding positions are referred with affix numeral 1 to 5. A wrapping angle that is formed with the medium come from roll MR1 is determined with θ1. A wrapping angle that is formed with the medium come from roll MR2 is determined with θ2. A wrapping angle that is formed with the medium come from roll MR3 is determined with θ3. A wrapping angle that is formed with the medium come from roll MR4 is determined with θ4. A wrapping angle that is formed with the medium come from roll MR5 is determined with θ5.

In the embodiment, wrapping angles θ1 to θ4 are configured to be greater than wrapping angle θ5. In a case where it is preferred to make an equipment space in which the roller is equipped small, the roller is preferred to be placed at feeding position P5 as shown in FIG. 9B. Also, in a case where a type of medium such as thick paper or a film is used, that has a tendency to be easily curled when the wrapping angle is large, the roll is preferred to be placed at feeding position P5 that is a position where roll MR5 is placed. In a case of not considering the equipment space and trying to reduce a winding of the medium that comes from the roll, the roll is preferred to be at feeding positions P2 to P5 where rolls MR2 to MR5 are placed). It is preferred that wrapping angle θ1 is within 145 degrees to 170 degrees, wrapping angle θ2 is within 133 degrees to 173 degrees, wrapping angle θ3 is within 127 degrees to 155 degrees, wrapping angle θ4 is within 118 degrees to 162 degrees, and wrapping angle θ5 is within 1 degrees to 40 degrees. As shown in FIG. 9C, wrapping angles satisfy a formula below:

$$\theta 1>\theta 2>\theta 3>\theta 4>\theta 5.$$

[Operation Effects]

(A. Medium Installation Method)

In the image forming apparatus, the medium feeding unit D1 and the roll MR are set as follows.

Here, first, a suitable position among the positions P1-P5 is selected by taking into account the type (material), the thickness, the winding amount (outer diameter) and the like of the medium M of the roll MR. For example, when the winding amount of the roll MR is small, one of the positions P1, P3, P5 is selected. As a result, an overall size of the image forming apparatus when the roll MR is attached can be suppressed. In particular, when the position P3 or the position P4 is selected, a dimension in the height direction (vertical direction) can be reduced. On the other hand, when the position P5 is selected, a dimension in the horizontal direction can be reduced. Further, when the medium M is formed of a hard material or has a relatively large thickness, bending of the medium M due to the tension roller 2 may be relaxed by selecting the position P3 or the position P4.

After one of the positions P1-P5 is selected, the projection T1 and the projection T2 of the arm part 12 are respectively fitted to one of the holes HA1-HA3 and one of the holes HB1-HB3, and the arm part 12 is attached to the main body part 10A at an appropriate position. Further, when one of the positions P1, P3, P5 is selected, the arm part 12 is in the contraction state; and when one of the positions P2, P4 is selected, the arm part 12 is in the extension state. Finally, the roll RM is attached to the support part 11.

(B. Print Operation)

In the image forming apparatus, a toner image is transferred to the medium M as follows. Specifically, as illustrated in FIG. 1, first, when the leading edge of the medium M pulled out from the roll RM is inserted into the medium inlet 3K from the holder 1 via the tension roller 2, the leading edge detection sensor 301 detects the leading edge of the medium M. As a result, the feed roller pair 302 starts rotation driving, the medium M is fed from the roll MR in a feed direction A, and the medium M is carried toward the medium cutting part 4 on a downstream side. The feed direction A of the medium M, for example, is set so as to form the predetermined entry angle θ (see FIG. 1) relative to the horizontal direction at the contact point between the medium M and the tension roller 2. When the leading edge position of the medium M fed from the feed roller pair 302 is detected by the leading edge detection sensor 303, the roller pair 403 starts driving. After being cut to have an arbitrary length, the medium M carried to the medium cutting part 4 is further carried by the rotation of the roller pair 403 to the write timing adjustment carrying part 5 positioned on a downstream side. The medium M carried to the write timing adjustment carrying part 5 is carried, at an appropriate timing, to the secondary transfer part in which the secondary transfer backup roller 704 and the secondary transfer roller 707 oppose each other.

In the image forming part 6 and the intermediate transfer belt unit 7, by the following electrophotographic process, toner images of respective colors are formed. That is, for example, due to a charging roller supplied with a predetermined applied voltage, a surface of a photosensitive drum is uniformly charged. Next, by exposing the surface of the photosensitive drum by irradiating light from an LED head to the surface of the photosensitive drum, an electrostatic latent image corresponding to a print pattern is formed on the photosensitive drum. Further, toner from a development roller is attached to the electrostatic latent image on the photosensitive drum. The toner (toner image) on the photosensitive drum is transferred to the surface of the intermediate transfer belt 701 due to an electric field between the photosensitive drum and the primary transfer roller 705 that is arranged opposing the photosensitive drum. Further, in the secondary transfer part, the toner image on the surface of the intermediate transfer belt 701 is transferred to the medium M.

Thereafter, the toner (toner image) on the medium M is fused by applying heat and pressure thereto in the fuser 8. Then, the medium M on which the toner is fused is ejected to the outside of the image forming unit D2 via the ejection carrying part 9.

(C. Effects)

In this way, in the image forming apparatus of the present embodiment, in the medium feeding unit D1, the position (relative position) of the support part 11 relative to the tension roller 2 can be selected according to a thickness, a type and a winding amount (remaining amount) of the medium M. For example, when the thickness of the medium becomes small, the support part 11 is able to be positioned closer to the tension roller 2. Therefore, the image forming apparatus has an advantageous configuration in terms of miniaturization as compared to a case where a support part of a medium feeding unit is always fixed at a fixed position. Thus, the image forming apparatus of the present embodiment is suitable for installation in a narrower place.

2. Second Embodiment

[Schematic Configuration]

Figure 8:
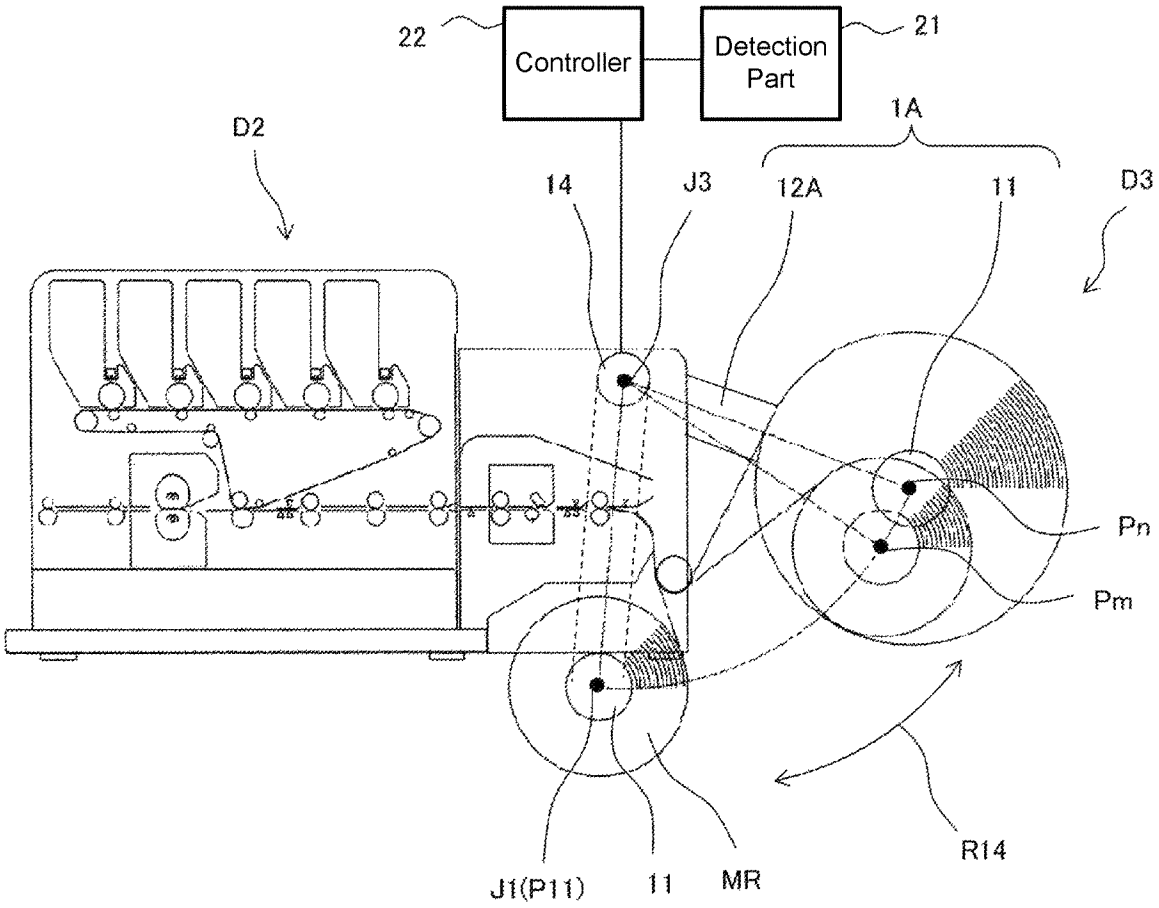
FIG. 8 is a schematic diagram illustrating an example of an overall configuration of an image forming apparatus according to a second embodiment of the present invention.

FIG. 8 is a schematic diagram illustrating an example of an overall configuration of an image forming apparatus according to a second embodiment of the present invention. This image forming apparatus has substantially the same configuration as the image forming apparatus of the first embodiment except that a medium feeding unit D3 is provided in place of the medium feeding unit D1. Therefore, in the following, the medium feeding unit D3 is mainly described, and the other configuration elements are denoted using the same reference numeral symbols as in the first embodiment and description thereof is omitted as appropriate.

The medium feeding unit D3, similar to the medium feeding unit D1, for example, includes a holder 1A, which corresponds to a specific example of a "medium holding part", and the tension roller 2. The holder 1A has the support part 11, and an arm part 12A on one end of which the support part 11 is attached. However, the other end of the arm part 12A is fixed to a rotation member 14 that is provided on the main body part 10A. The rotation member 14 is a shaft that swings about axis J3. Due to the swing of the rotation member 14, the arm part 12A swings about the axis J3 along an arrow R14 direction. Therefore, the roll RM attached to the support part 11 can be installed continuously or stepwise at an arbitrary position P (P11, . . . Pm, . . . , Rn). Therefore, also in the present embodiment, in the medium feeding unit D3, the position (relative position) of the support part 11 relative to the tension roller 2 can be selected according to the thickness, the type and the winding amount (remaining amount) of the medium M.

Further, the medium feeding unit D3 of the present embodiment may also include a detector 21 that detects a remaining amount of the medium M in the attached roll MR, and a controller 22 that controls the rotation member 14 so as to change the position of the support part 11 according to the remaining amount of the medium M detected by the detector 21. For example, the controller 22 may control the rotation member 14 such that the entry angle θ of the medium M relative to the tension roller 2 (or a position on a circumferential surface of the tension roller 2 at which the medium M first becomes in contact with the tension roller 2) is nearly a constant or is within a predetermined range. This is because a print operation can be more stably performed.

In this way, in the present embodiment, since the support part 11 is provided on one end of the arm part 12A that is rotatable about the rotation member 14, the roll MR can be installed as any position. That is, also in the medium feeding unit D3, the position (relative position) of the support part 11 relative to the tension roller 2 can be selected according to the thickness, the type and the winding amount (remaining amount) of the medium M. Therefore, the image forming apparatus has an advantageous configuration in terms of miniaturization as compared to a case where a support part of a medium feeding unit is always fixed at a fixed position. Thus, the image forming apparatus of the present embodiment is suitable for installation in a narrower place. Further, since the medium feeding unit D3 has the movable arm part 12A, the position of the roll MR can be more easily changed than that in the medium feeding unit D1 of the first embodiment. In addition, the position of the roll MR can be changed even during a print operation, and thus, a high handleability can be achieved.

In another embodiment, the invention is performed to control the relative position by moving the tension roller 2 in correspondence with a status of the medium M.

3. Other Modified Embodiments

In the above, the present invention is described by illustrating a few embodiments. However, the present invention is not limited to these embodiments and the like, and various modified embodiments are possible.

For example, in the above embodiments, the image forming apparatus that forms a color image is described. However, the present invention is not limited to this. For example, the present invention is also applicable to an image forming apparatus in which only a toner image of a black color is transferred and a black-and-white image color image is formed.

Further, in the above embodiments and the like, the LED head having a light emitting diode as a light source is used as an exposure part. However, for example, a laser element or the like may also be used as a light source.

Further, in the above embodiments and the like, the tension roller (2) is provided at a position between the support part (11) that supports the roll (MR) and the medium inlet (3K). However, in the present invention, this may be omitted. That is, it is also possible that the medium (M) is directly fed from the roll (MR) that is rotatably supported by the support part (11) to the medium carrying part (3) or the write timing adjustment carrying part (5) of the image forming unit (D2). In these cases, the medium inlet (3K) of the medium carrying part (3) or the timing adjustment roller pair (501) of the write timing adjustment carrying part (5) corresponds to a specific example of the "medium introducing part" of the present invention.

Further, in the above embodiments and the like, as a specific example of the "image forming unit" of the present invention, an image forming apparatus having a print function is described. However, the present invention is not limited to this. That is, the present invention is also applicable to an image forming unit that functions as a multifunction machine that has, for example, a scan function, a fax function, or an image display function, in addition to the print function.

What is claimed is:

1. A medium feeding unit configured to be mounted to an image forming apparatus provided with an image forming unit and configured to feed a medium to the image forming unit, comprising:

a medium introducing part configured to introduce the medium to the image forming unit;

a medium holding part configured to hold the medium at a feeding position from which the medium is fed to the image forming unit, and configured to include a support part that has a rotation axis around which the medium is rotatably supported and that is configured to be fixedly arranged at one of at least two different feeding positions relative to the medium introducing part and to be fixed to the medium introducing part during the medium feeding;

a detector configured to detect a remaining amount of the medium; and a controller configured to change a position of the support part according to the remaining amount of the medium detected by the detector, and control an entry angle of the medium relative to the medium introducing part to be within a predetermined range.

2. The medium feeding unit according to claim 1, wherein the medium holding part is configured such that a position of the medium holding part relative to the medium introducing part is changeable, and by changing the position of the medium holding part relative to the medium introducing part, the entry angle of the medium relative to the medium introducing part is adjusted.

3. The medium feeding unit according to claim 1, wherein the medium introducing part includes a tension force application part configured to apply a tension force to the medium.

4. The medium feeding unit according to claim 1, wherein the medium holding part includes an arm part that has two ends in a longitudinal direction, and the support part is attached to one end of the arm part.

5. The medium feeding unit according to claim 4, wherein the arm part includes the other end that is positioned on a side opposite to the one end where the support part is attached, and is provided to be swingable around the other end serving as the rotation axis.

6. The medium feeding unit according to claim 4, wherein the one end of the arm part is configured to be extendable and contractible along the longitudinal direction of the arm part.

* * * * *